United States Patent [19]

Huntley et al.

[11] 4,431,248

[45] Feb. 14, 1984

[54] FLAT CABLE CONNECTOR

[75] Inventors: Ted R. Huntley, Lake Elmo; Ralph E. Huntosh, Jr., New Scandia Township, Washington County, both of Minn.

[73] Assignee: Minnesota Mining and Manufacturing Company, Saint Paul, Minn.

[21] Appl. No.: 404,443

[22] Filed: Aug. 2, 1982

Related U.S. Application Data

[63] Continuation of Ser. No. 228,756, Jan. 27, 1981, abandoned.

[51] Int. Cl.[3] ..... H01R 13/39

[52] U.S. Cl. ..... 339/99 R

[58] Field of Search ..... 339/17 F, 97 R, 97 P, 339/98, 99 R, 103 M

[56] References Cited

U.S. PATENT DOCUMENTS 4,006,957 2/1977 Narozny ..... 339/103 M
4,009,921 3/1977 Narozny ..... 339/99 R
4,168,877 9/1979 Little ..... 339/103 M
4,190,952 3/1980 Thomas ..... 339/99 R

FOREIGN PATENT DOCUMENTS 2921805 12/1979 Fed. Rep. of Germany .... 339/99 R
2033676 9/1979 United Kingdom ..... 339/99 R

*Primary Examiner*—Joseph H. McGlynn
*Attorney, Agent, or Firm*—Donald M. Sell; James A. Smith; Terryl K. Qualey

[57] ABSTRACT

A connector for making interconnection between the conductors in a flat cable and a terminal post grid on a printed circuit board has a molded plastic contact carrier in which the wire connection ends of the contacts exit from one surface of the carrier and the wiping blades exit from the opposite surface. The wiping blades are progressively further spaced from the center of the carrier than their associated wire connection ends progressing from the center toward both ends of the carrier to leave space at the ends of the carrier on the wire contact surface for cover latching members for latching a cover over a flat cable with its conductors electrically connected to the wire connection ends of the contact elements.

5 Claims, 4 Drawing Figures

FLAT CABLE CONNECTOR

CROSS-REFERENCE TO RELATED APPLICATION

This is a continuation of application Ser. No. 228,756 filed on Jan. 27, 1981, now abandoned.

FIELD OF THE INVENTION

The present invention relates to a connector for interconnecting the conductors of a flat cable and terminal posts in a grid on a printed circuit board.

BACKGROUND OF THE INVENTION

Terminal posts on the back plane of telecommunications equipment are arranged in a grid. Most commonly, square posts having a width of 0.025 inch (0.064 cm.) are used with a spacing between adjacent posts of 0.125 inch (0.318 cm.). Flat cables having a plurality of conductors in a single insulating sheath are frequently interconnected with a plurality of the terminal posts by socket connectors which have contact elements having wire connection ends extending from one surface and wiping blades in sockets in the opposite surface for receiving the terminal posts. When many of these socket connectors are engaged with terminal posts on a back plane they interfere with the terminal posts immediately adjacent the connector so that another connector cannot be used to connect those terminal posts. Connectors with a sufficiently compact design to utilize all of the posts in a grid are disclosed in U.S. Pat. Nos. 4,083,615 and 4,181,384. However, with both of these connectors it is necessary to strip out and individually handle each of the conductors in the flat cable. This is undesirable because it is, of course, very time consuming.

SUMMARY OF THE INVENTION

The present invention provides a flat cable connector comprising a molded plastic contact carrier and a multiplicity of electrical contact elements molded into the contact carrier in two parallel rows. Each contact element has a slotted insulation displacement wire connection end protruding from one surface of the carrier and a wiping blade protruding from the opposite surface of the carrier. The slotted ends of the contacts are staggered to receive the parallel conductors of a flat cable alternately in a contact in one row and then a contact in the other row and the wiping blade of a contact in one row is aligned with the wiping blade of a contact in the other row. The wiping blades are progressively further spaced from the center of the carrier than their associated wire connection ends progressing from the center toward both ends of the carrier. A pair of latching members extend from the same surface of the carrier as the wire connection ends of the contact elements, one at each end of the rows of contact elements. The latching members are at least partially in transverse planes through the carrier that also pass through the end wiping blades extending from the opposite surface of the carrier. A plastic cover is slotted on one surface to receive the wire connection ends of the contact elements and is formed at its ends with portions complementary to the latching members for latching the cover to the contact carrier.

The fanning out of the wiping blade end of the contact elements to a spacing greater than that of the wire connection ends provides for the use of a flat cable having a width less than the corresponding length of the grid pattern of terminal posts to be connected on the printed circuit board. This leaves space at the ends of the rows of the wire connection ends of the contact elements for the latching members so that they do not protrude out beyond the ends of the wiping blades which are on the same spacings as the terminal posts. Interference of the connector with adjacent terminal posts is thereby avoided.

THE DRAWING

Figure 1:
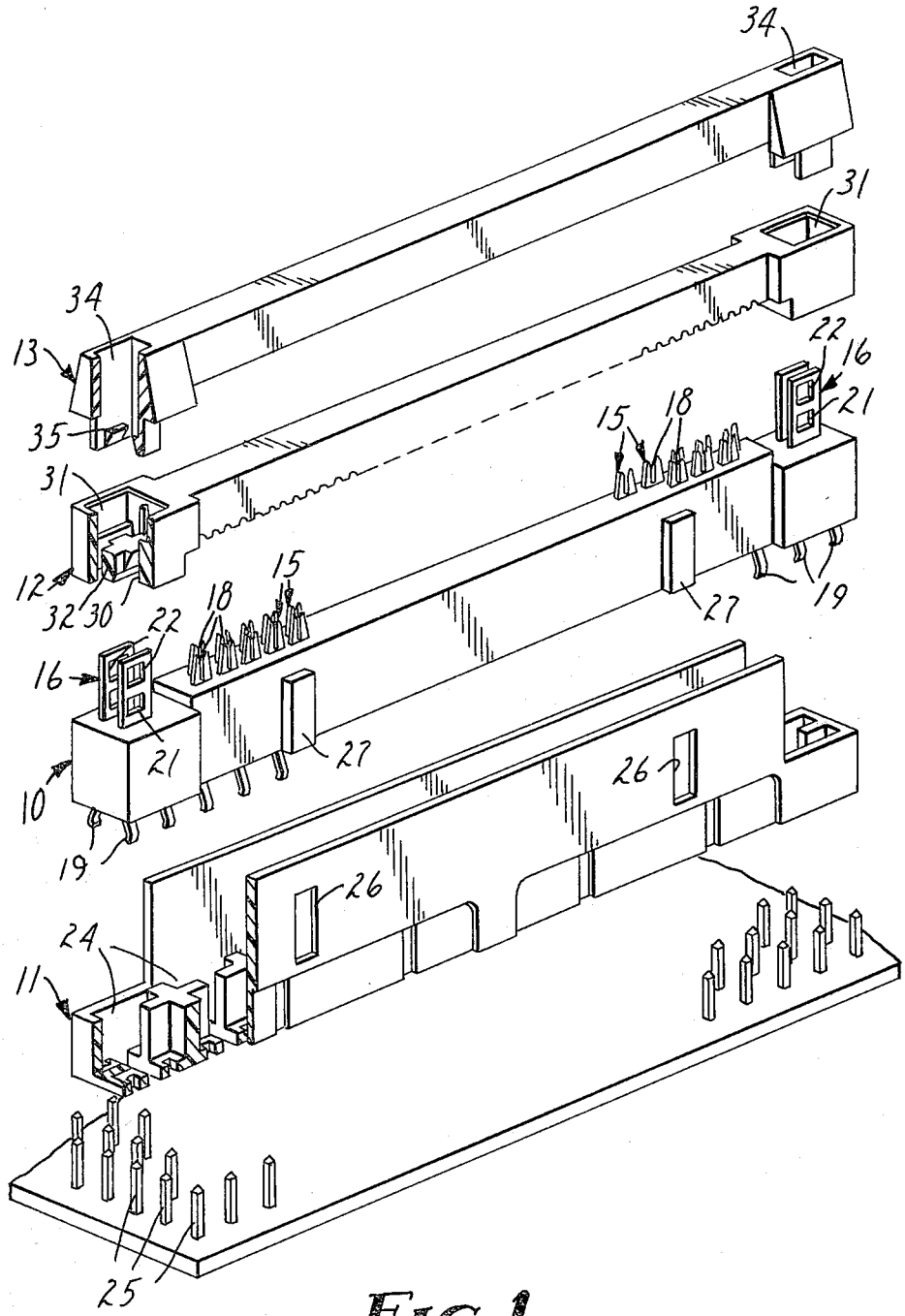
FIG. 1 is an exploded perspective view of a flat cable connector constructed in accordance with the present invention with parts broken away to show detail and a portion of a printed circuit board with a grid pattern of terminal posts.

The cable connector comprises a contact carrier 10, a body 11 for the contact carrier 10, a cover 12 and a strain relief clip 13. The body 11, cover 12 and strain relief clip 13 are entirely molded plastic, preferably a 30% glass filled thermoplastic polyester.

The contact carrier 10 is plastic, also preferably a 30% glass filled thermoplastic polyester, and it has a multiplicity of electrical contact elements 15 and four spring metal latching blades 16 insert molded into it. Each contact element 15 is formed of berylium-copper and has a slotted insulation displacement wire connection end 18 protruding from one surface of the carrier 10 and a wiping blade 19 protruding from the opposite surface of the carrier. The contacts 15 are in two parallel rows and the wire connection ends 18 are staggered to receive 0.050 inch (0.127 cm) spaced parallel conductors of a flat cable 20 alternately in a contact in one row and then a contact in the other row. The wiping blade 19 of a contact in one row is aligned with the wiping blade of a contact in the other row and the wiping blades are spaced to correspond to terminal posts in a 0.125 inch (0.318 cm.) grid. The wiping blades 19 are progressively further spaced from the center of the carrier than their associated wire connection ends 18 progressing from the center toward both ends of the carrier so that the rows of wire connection ends occupy a lesser length of the contact carrier 10 on the upper surface than do the wiping blades 19 on the lower surface of the contact carrier. This leaves room at the ends of the contact carrier for a pair of latching members extending from the same surface of the carrier 10 as the wire connection ends 18 of the contact elements.

In the illustrated embodiment each latching member consists of a pair of spring metal latching blades 16, one pair at each end of the rows of wire connection ends 18 of the contact elements 15. Each pair of latching blades 16 is a single strip of spring metal, preferably three quarter hard stainless steel, which is formed into a U-shape with the base of the U molded into the plastic contact carrier 10. Each latching blade 16 is formed with two apertures, a cover latch aperture 21 and a strain relief latch aperture 22 spaced further from the surface of the contact carrier than the cover latch aperture. Planes passing through the latching blades 16 transversely through the carrier 10 also intersect the last wiping blade 19 and a portion of the next to the last wiping blade at each end of the contact carrier 10.

The body 11 has a generally U-shaped cross section with a length corresponding to the length of the contact carrier 10. The base of the body 11 has apertures 24 therethrough into which the wiping blades 19 of the contact elements 15 extend into position for making wiping contact with terminal posts 25 entering the apertures from the exterior of the body. The walls of the body 11 are formed with four latching openings 26 and the contact carrier 10 is formed with corresponding projections 27 to latch the contact carrier into the body.

The cover 12 has a length corresponding to that of the contact carrier 10 and it is formed with slots 29 in one surface positioned to receive the wire connection ends 18 of the contact elements 15. At each end the cover 12 is formed with a pair of openings 30 in its lower portion dimensioned to receive the pair of latching blades 16 at one end of the contact carrier 10. In its upper portion each end of the cover has an opening 31 of increased size. Within each of the lower openings 30 the cover is formed with a latching projection 32 complementary to the cover latching apertures 21 in the latching blades 16 for latching the cover to the contact carrier.

The strain relief clip 13 has a shape similar to that of the cover 12. It has end openings 34 dimensioned to closely surround a pair of latching blades 16 and it is formed with a pair of opposed latching projections 35 at the bottom of each opening 34 which are complementary to the strain relief latching apertures 22 in the latching blade 16. The lower exterior portion of each end of the strain relief clip 13 has a reduced dimension corresponding to the upper opening 31 in the ends of the cover to fit therein.

Figure 3:
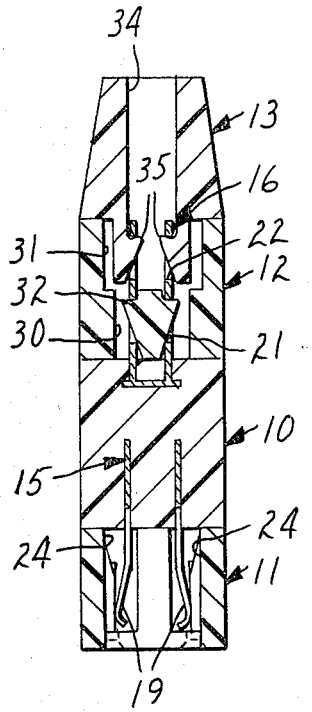
FIG. 3 is a cross-sectional view taken along line 3—3 of FIG. 2.
Figure 2:
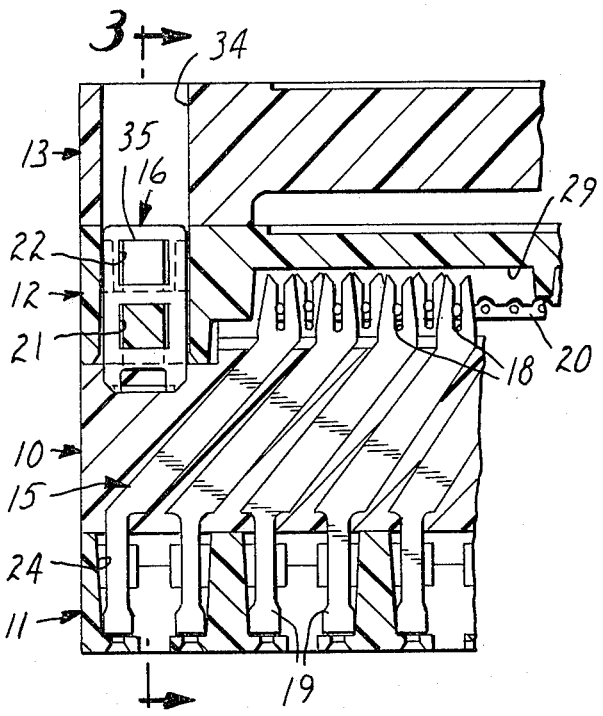
FIG. 2 is a partial longitudinal cross-sectional view of the assembled connector of FIG. 1.
Figure 4:
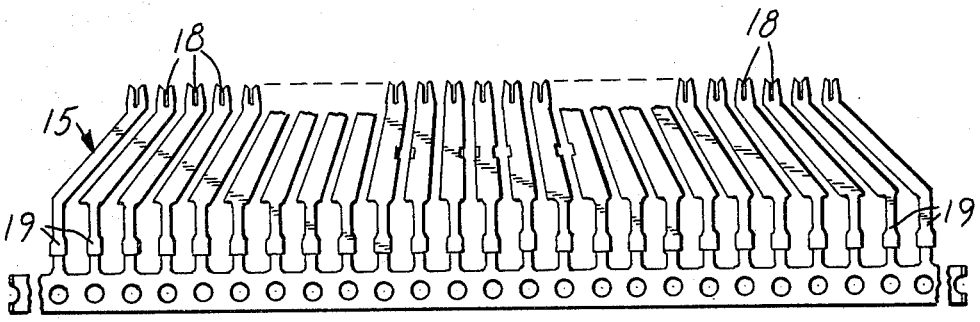
FIG. 4 is a side view of the contact elements prior to their being molded into the contact carrier of the connector.

The contact carrier 10 and the body 11 are made separately for ease of manufacture and they are assembled as shown in FIGS. 2 and 3 as part of the manufacturing process. In use, the cover 12 may be placed over the contact carrier 10 and moved downward until its latching projections 32 engage the strain relief latching apertures 22 in the latching blade 16. In this preassembled position a flat cable 20 can be inserted between the cover 12 and the wire connection ends 18 of the contact elements 15 in the contact carrier 10. After the cable 20 has been inserted, pressure is applied to force the cover toward the contact carrier thereby carrying the conductors of the flat cable 20 into the wire connection slots in the contact elements 15 and moving the cover onto the contact carrier until its latching projections 32 engage the cover latching apertures 21 in the latching blade 16. The cable 20 may then be folded over the cover 12 and the strain relief clip 13 placed over the cover and moved downward until its latching projections 35 engage the strain relief latching apertures 22 in the latching blade 16. The connector is then ready to be plugged onto a grid of terminal posts 25 to make connection between the conductors in the flat cable 20 and the terminal posts 25.

What is claimed is:

1. A flat cable connector comprising:

a molded plastic contact carrier, a multiplicity of electrical contact elements molded into said contact carrier in two parallel rows, each said contact element having a slotted insulation displacement wire connection end protruding from one surface of said carrier and a wiping blade protruding from the opposite surface of said carrier, the wire connection ends of said contacts being staggered to receive the parallel conductors of a flat cable alternately in a contact in one row and then a contact in the other row and the wiping blade of a contact in one row being aligned with the wiping blade of a contact in the other row, said wiping blades being progressively further spaced from the center of said carrier than their associated wire connection ends progressing from the center toward both ends of said carrier, a pair of latching members extending from said one surface of said carrier, one at each end of the rows of said protruding wire connection ends of said contact elements, said latching members being at least partially in transverse planes through said carrier that also pass through the end wiping blades extending from the opposite surface of said carrier and extending longitudinally of said carrier toward the ends thereof no further than the end wiping blades, a plastic cover slotted on one surface to receive said wire connection ends of said contact elements and being formed at its ends with portions complementary to said latching members for latching said cover to said contact carrier.

2. The flat cable connector of claim 1 wherein said latching members on said contact carrier comprise spring metal latching blades molded into each end of said contact carrier, each said latching blade being formed with a cover latching aperture and wherein said cover is formed with latching projections to fit into said cover latching apertures in said latching blades to latch said cover to said contact carrier.

3. The flat cable connector of claim 2 wherein each of said latching blades extends through an opening in said cover when latched and is formed with a strain relief latching aperture spaced further from said one surface of said contact carrier than said cover latching aperture, and including a plastic strain relief clip to fit over said cover and being formed at its ends with latching projections to fit into said strain relief latching apertures in said latching blades to latch said strain relief clip to said contact carrier.

4. The flat cable connector of claim 2 or 3 wherein there are two of said spring metal latching blades at each end of said contact carrier.

5. The flat cable connector of claim 1, 2 or 3 including a plastic body receiving and retaining said contact carrier; said body having a generally U-shaped cross-section and a length corresponding to the length of said contact carrier, the base thereof having apertures therethrough into which said wiping blades of said contacts extend into position for making wiping contact with terminal posts entering said apertures from the exterior of said body.

* * * * *